US006371621B1

(12) United States Patent
Le Bel

(10) Patent No.: US 6,371,621 B1
(45) Date of Patent: Apr. 16, 2002

(54) SERVO-CONTROLLED CONCEALED EMERGENCY LIGHT FIXTURE

(75) Inventor: Vincent Victor Le Bel, Tara (CA)

(73) Assignee: SPX Corporation, Muskegon, MI (US)

( * ) Notice: Subject to any disclaimer, the term of this patent is extended or adjusted under 35 U.S.C. 154(b) by 0 days.

(21) Appl. No.: 09/487,959

(22) Filed: Jan. 19, 2000

Related U.S. Application Data

(60) Provisional application No. 60/159,256, filed on Oct. 13, 1999.

(51) Int. Cl.[7] ..... F21V 19/04

(52) U.S. Cl. ..... 362/20; 362/286; 362/270; 362/272

(58) Field of Search ..... 362/286, 285, 362/20, 147, 386, 250, 271, 272, 287, 364, 270

(56) References Cited

U.S. PATENT DOCUMENTS 4,708,223 A * 11/1987 Orndorff et al. ..... 362/20
5,682,131 A * 10/1997 Gow ..... 340/286.11
6,164,788 A * 12/2000 Gemmell et al. ..... 362/20

* cited by examiner

*Primary Examiner*—Alan Cariaso
*Assistant Examiner*—Bao Truong
(74) *Attorney, Agent, or Firm*—Baker & Hostetler LLP

(57) ABSTRACT

An improved flush-mount emergency light fixture (10) is provided having a housing (12) adapted for placement in a wall or ceiling aperture (20), an internal illumination assembly (16) and a selectively movable cover (14), in order to provide illumination during an emergency condition. The fixture (10) includes a servo-motor (74) and an operator (78) for controlled movement of the cover (14) between a closed position and a deployed illumination position. A floating hinge (54) couples the cover (14) to housing (12) and allows the cover to both pivot and translate relative to the housing (12) during cover movement.

6 Claims, 2 Drawing Sheets

SERVO-CONTROLLED CONCEALED EMERGENCY LIGHT FIXTURE

RELATED APPLICATION

This Application claims benefit from the Provisional Patent application Ser. No. 60/159,256, filed Oct. 13, 1999, and entitled SERVO-CONTROLLED CONCEALED EMERGENCY LIGHT FIXTURE, the teachings of which are incorporated herein by reference.

BACKGROUND OF THE INVENTION

1. Field of the Invention

The present invention is broadly concerned with an improved emergency light fixture which is designed for essential flush mounting in a wall or ceiling but which is automatically deployed to provide illumination in the event of an emergency. More particularly, the invention pertains to such an emergency light fixture which includes a housing for an illumination assembly with a selectively openable cover; the cover is movable through a servo-motor and crank, thereby completely eliminating the need for limit switches in the fixture. A special cover hinge also causes the cover to both pivot and translate during movement thereof.

2. Description of the Prior Art

Office buildings and other similar structures are universally provided with emergency lighting fixtures designed to illuminate in the event of a fire or other emergency. For example, battery-operated fixtures are located in stairwells and are often surface-mounted. While these units do serve an important purpose, they are considered unsightly and many designers hesitate to use them in formal offices or other settings where aesthetics are a consideration.

It has also been known to provide flush-mounted emergency light fixtures having a pivotal cover. In such units, an illumination assembly is located in a recessed housing or the like and when an emergency occurs, the cover is pivoted open and the recessed lamps are illuminated. Deployment of these prior flush-mounted emergency lighting fixtures is typically achieved by means of an electric motor and various limit switches to stop the operation of the cover in both the open and close directions. However, upon failure of the limit switches, these units tend to self-destruct and become unusable. An additional problem with these prior units is that it is difficult to provide a cover opening mechanism which will assure that the cover opens in a smooth, reliable and controlled way even after extended periods of non-use.

There is accordingly a need in the art for an improved emergency lighting fixture which eliminates all potentially troublesome limit switches and gives accurate and reliable cover movement at all times.

SUMMARY OF THE INVENTION

The present invention overcomes the problems outlined above, and provides an improved emergency light fixture of the flush-mounted variety. Broadly speaking, the fixture of the invention includes a housing adapted for placement in a wall or ceiling aperture and presenting an opening, with a shiftable cover movable between a closed position and an open position; an illumination lamp is located within the housing when the cover is in its closed position, but preferably is moved at least partially out of the housing when the cover is open. The overall fixture further includes an operating assembly coupled with the cover and lamp in order to selectively move the cover and operate the lamp. The assembly includes a servo-motor having an output, with an operator connected between the output and the cover for moving the cover towards its open and closed positions. A control circuit is also provided which is coupled with an emergency power source and connected with the servo-motor and lamp respectively.

In preferred forms, a pair of illumination lamps are provided, and these are connected to the cover in order to provide a gravity assist during cover opening and to insure that the full illumination power of the lamps is utilized. The cover is secured to the housing by means of a special hinge which causes the cover to both pivot and translate relative to the housing during cover movement. This special hinge comprises first and second hinge parts respectively connected to the housing and cover, with a hinge pin interconnecting the hinge parts; the first hinge part is connected with the housing in a floating manner and translates during cover movement by virtue of a slot/connector arrangement between the hinge part and housing.

Use of a servo-motor and appropriate control circuitry permits the cover to be accurately moved between its open and close positions without the need for limit switches, and the preferred floating hinge arrangement facilitates reliable cover control.

DETAILED DESCRIPTION OF THE PREFERRED EMBODIMENT

Figure 1:
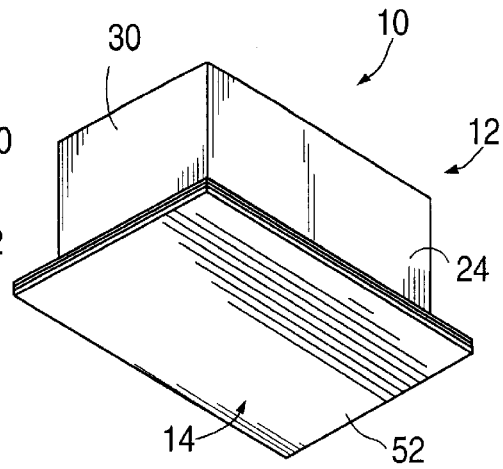
FIG. 1 is a perspective view of the preferred emergency light fixture of the invention, shown with the cover thereof in its closed position.
Figure 2:
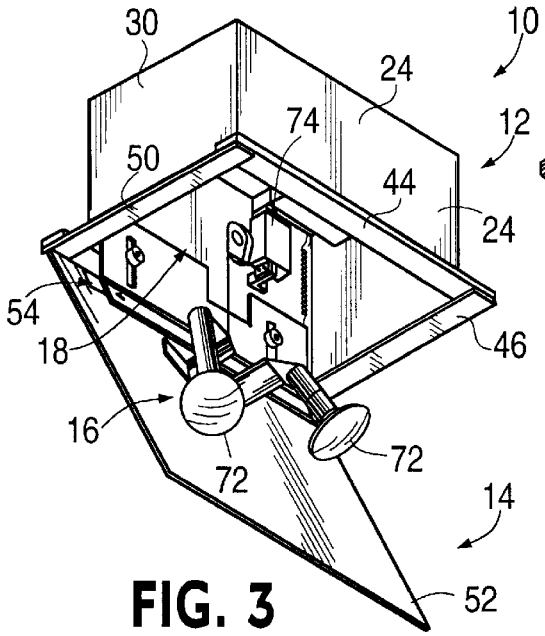
FIG. 2 is a perspective view similar to that of FIG. 1, but illustrating the cover in its open position during emergency use of the light fixture.
Figure 3:
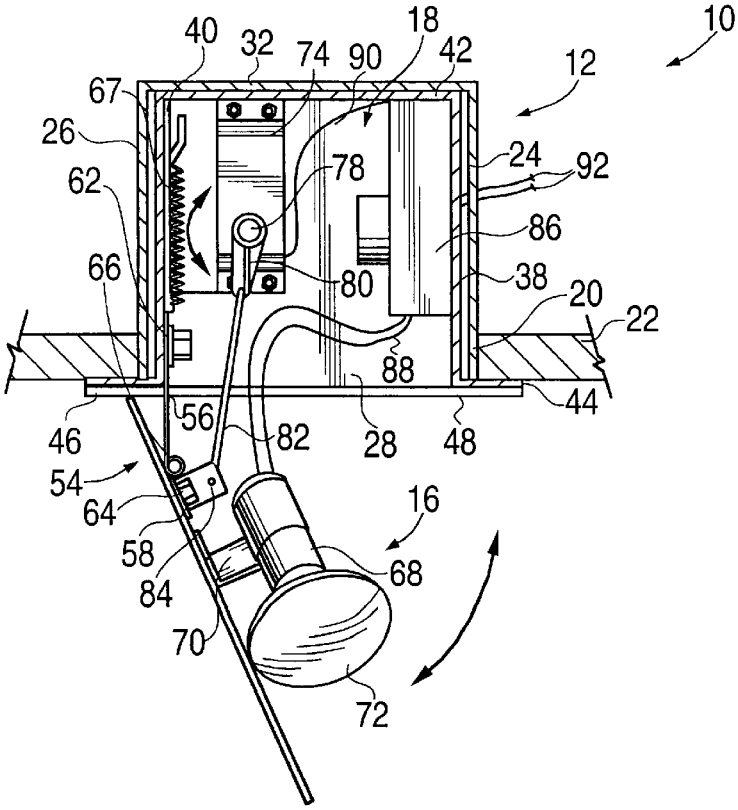
FIG. 3 is a vertical sectional view of the preferred light fixture of the invention, shown mounted in a ceiling and during deployment and use of the fixture.

Turning now to the drawings, and particularly FIGS. 1–3, an emergency light fixture 10 in accordance with the invention broadly includes a housing 12, shiftable cover 14, an illumination lamp assembly 16, and an operating assembly 18. The fixture 10 is designed to be located in an opening 20 provided in a wall or ceiling 22, so that the fixture is essentially flush-mounted to the wall or ceiling. The fixture 10 is normally in the position depicted in FIGS. 3 and 4 with cover 14 closed; however, in an emergency situation the cover 14 is opened and the lamp assembly 16 is activated to illuminate the lamps, thereby providing illumination to facilitate escape from a building or the like.

Figure 4:
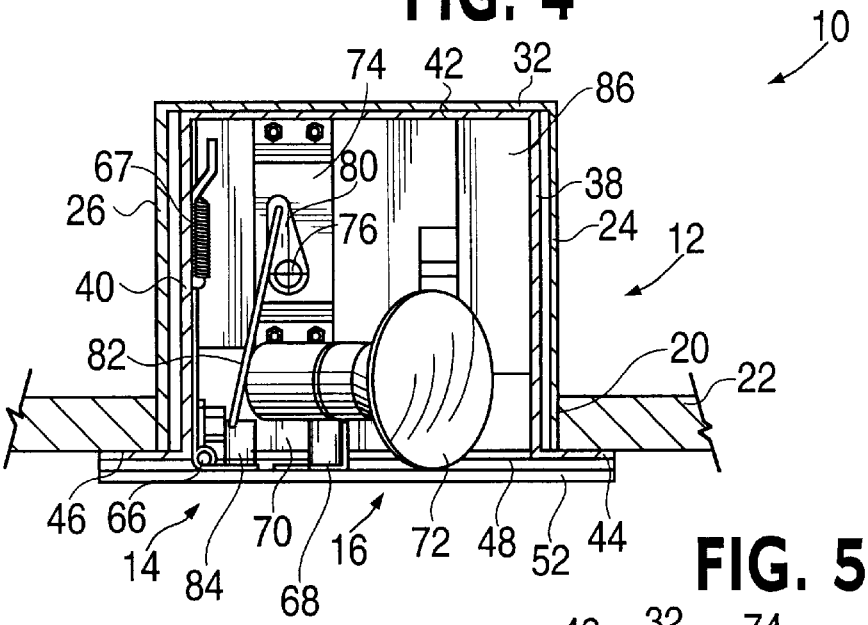
FIG. 4 is a vertical sectional view similar to that of FIG. 1, but showing the fixture in its normal closed and inactive position.

In more detail, the housing 12 is in the form of an open-bottom box, presenting front and rear walls 24, 26, side panels 28, 30 and top wall 32. The housing 12 thus defines a deployment opening 34 in opposed relationship with the top wall 32. As best seen in FIG. 2, a generally U-shaped liner 36 is positioned within the housing 12 and includes front and rear segments 38, 40 respectively adjacent the housing walls 24, 26, as well as a top segment 42 adjacent housing top wall 32. The front and rear segments 38, 40 include laterally projecting flanges 44, 46 as best seen in FIG. 4. Additional side flanges 48, 50 are connected to the liner flanges 44, 46. Thus, the flanges 44–50 circumscribe opening 34 and abut the regions of wall or ceiling 22 adjacent opening 20. Although not specifically depicted in the drawings, it may be preferable to incorporate a continuous flange in lieu of the flanges 44–50, so as to permit the fixture to be mounted in essentially flush relationship to the wall or ceiling.

Figure 5:
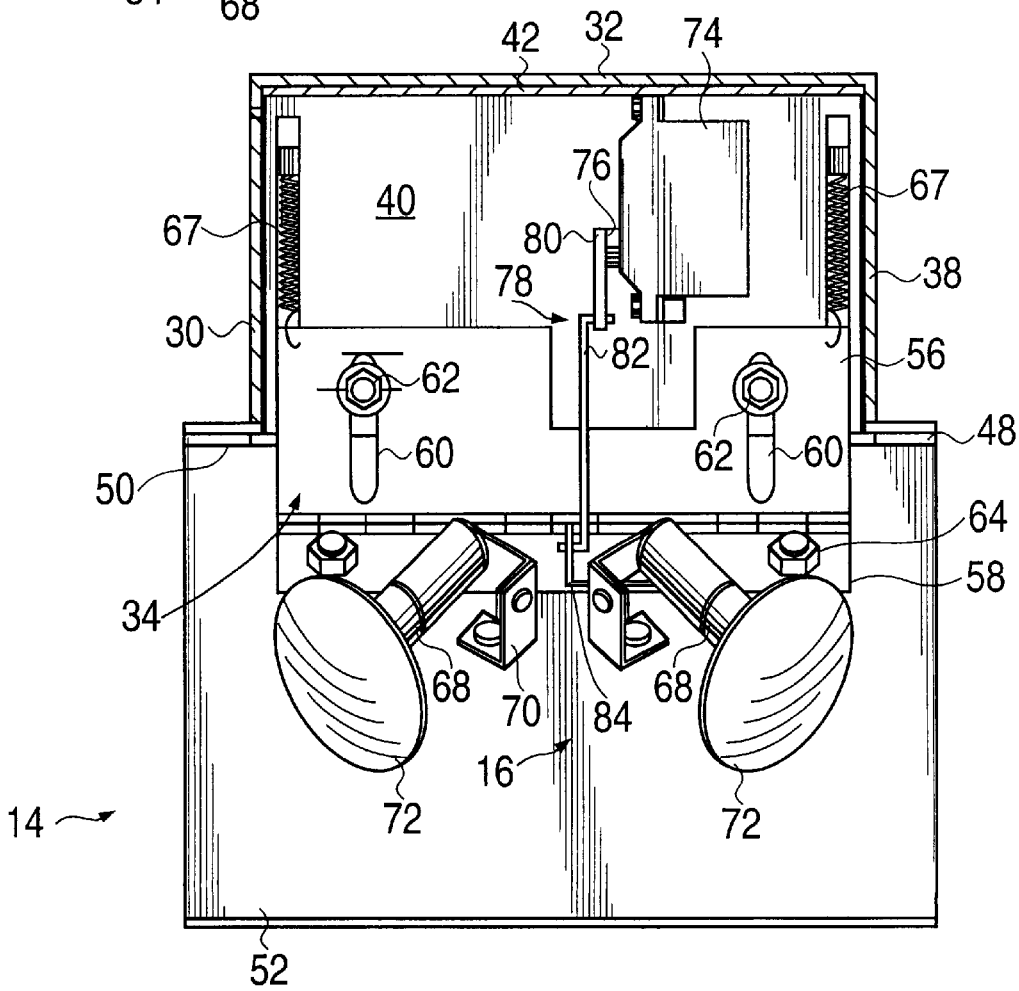
FIG. 5 is a vertical sectional view illustrating the fixture in its open and deployed position, and illustrating details of construction of the preferred cover hinge.

The cover 14 is a simple plate 52 which is of a size to abut the flanges 44–50 when the cover is in its closed position, and of course it also covers the opening 34 in this orientation. Cover 14 is secured to housing 12 via a specialized floating hinge 54. In particular, the hinge 54 includes first and second hinge parts 56, 58 respectively coupled to the housing 12 and cover 14. As best seen in FIG. 5, the hinge part 56 includes a pair of elongated slots 60, with a bolt connector 62 extending through each slot 60 and coupled to liner segment 40, in order to permit relative sliding movement of the hinge part 56 relative to the housing 12. The hinge part 58 is fixed to the cover 14 by connectors 64. The two hinge parts 56, 58 are interconnected by hinge pin 66 in the usual fashion. A pair of coil springs 67 are interconnected between the liner segment 40 and hinge part 56 (see FIG. 5), so as to bias the hinge 54 towards the cover-closed position.

The lamp assembly 16 includes a pair of adjacent lamp holders 68 each secured to the upper surface of cover plate 52 by mounts 70. Each holder 68 receives a flood lamp 72.

The operating assembly 18 is located within housing 12 and includes a conventional pulse proportional servo-motor 74 having a pivotal output 76. As shown, the motor 74 is connected to liner segment 42 and depends therefrom. An operator 78, comprising first and second pivotally interconnected crank arms 80, 82, is connected between output 76 and cover 14; in particular, an upstanding attachment plate 84 is secured to the upper surface of cover plate 52 between the mounts 70 and pivotally receives the end of crank arm 82.

The assembly 18 further includes a control circuitry 86 containing conventional circuit components which are operatively connected to the lamp holders 68 via leads 88, and to motor 74 via lead 90. Power source leads 92 from a battery or other emergency power source (not shown) extend through appropriate openings in the housing wall 24 and liner segment 32, and form the power input to the control circuitry 86. As will be readily understood by those skilled in the art, the control circuitry is designed, when the fixture 10 is in the normal inactive position shown in FIGS. 1 and 4, to illuminate the lamps 72 and activate servo-motor 74 when an emergency condition is sensed and the control circuitry is energized via the leads 92. Moreover, when the fixture 10 is in the deployed condition depicted in FIGS. 2, 3 and 5, the control circuitry is designed to extinguish the lamp 72 and activate motor 74 to close the cover 14 after an emergency condition is over.

The control circuit provides the motor 74 with operational signals generated by a dual timer IC. One timer output provides a repetitive pulse of preselected width to satisfy the servo when it is in the extreme cover open position, while the other timer output gives a repetitive pulse width proportional to the desired cover closed position. By this method, precise cover positioning is achieved without the need for costly and unreliable limit switches.

Power to the circuitry 86 is provided by two sources. An emergency power source or battery causes the fixture to open and illuminate when applied. A second power source provides the closure signal, which is applied for a period of not more than ten seconds, preferably 5±3 seconds.

In order for the fixture 10 to be used in insulated ceilings or walls, a normally closed resettable thermostat may be incorporated. The thermostat may be added to insure operation of the fixture when it would otherwise not deploy in the emergency mode.

Under normal or cover-closed conditions, the fixture 10 does not require power. Cover closure is maintained mechanically by virtue of the position of the operator 78, which preferably stops at or beyond the point at which the cover 14 can be forced open, thus minimizing the possibility of inadvertent gravity opening of the cover 14.

Upon activation via power applied to the emergency power input, the lamps 72 immediately illuminate and the circuitry 86 provides the "open" pulse, thereby causing the servo-motor output to rotate. As long as emergency power is applied, the circuitry 86 maintains the exact, cover full-open position of the servo-motor. The circuitry includes a potentiometer permitting setting of the servo to a desired cover full-open position.

Upon removal of emergency power and reapplication of normal power, the lamps 72 turn off and the servo control circuit 86 issues a pulse causing the servo-motor output 76 to rotate approximately 180° in the opposite direction, thereby causing the cover 14 to close. The cover close/normal power condition of the fixture 10 is preferably derived from the emergency source or battery using a time delay relay which provides a cover closure signal for a short period of time. Thus, when normal AC power is restored, the emergency power source is disconnected and the time delay relay times out to momentarily provide power to the fixture 10 so as to close cover 14. At this point, the fixture 10 is back in its ready position and does not consume any power.

During deployment or closure of the fixture 12, i.e., when the cover 14 is moved between its operative positions, the hinge 54 comes into play. In particular, the hinge 54 causes the cover to both pivot relative to the housing, and also to translate relative thereto. As can be appreciated, during cover movement between the closed and open positions, the cover translates away from the housing 12, whereas during closure the cover translates towards the housing. Such translatory movement is afforded by virtue of the sliding and floating connection provided by the slots 60 and connectors 62 described previously.

I claim:

1. An emergency light fixture comprising:

a housing adapted for placement in a wall or ceiling aperture and presenting an opening;

a shiftable cover movable between a closed position covering said opening and an open position at least partially spaced from the opening;

an illumination lamp located within said housing when said cover is in said closed position thereof;

a hinge connecting said cover to said housing and causing the cover to both pivot and translate relative to said housing during said movement of said cover, said hinge including first and second hinge parts respectively connected to said housing and cover respectively, with a hinge pin interconnecting the hinge parts, the first hinge part connected with said housing translating during said movement of said cover; and an operating assembly operably coupled with said cover and lamp in order to selectively move said cover and operate said lamp, said assembly including a pulse proportional servo-motor having an output, an operator connected between said output and cover for moving the cover between said closed and opened positions, and a control circuit adapted for coupling with an emergency power source and connected with said pulse proportional servo-motor and lamp respectively, wherein said first hinge part having an elongated slot formed therein, there being a connector extending through said slot for attaching the first hinge part to said housing, said first hinge part being slidable relative to said connector and housing during said movement of said cover.

2. The light fixture of claim 1, including a spring connected between said housing and first hinge part for biasing the cover to said closed position thereof.

3. The light fixture of claim 1, wherein said output comprising a pivotal shaft, said operator comprising a pair of pivotally interconnected crank elements.

4. The light fixture of claim 1, wherein said lamp being secured to said cover.

5. The light fixture of claim 1, wherein said control circuit operable, when said cover is in said closed position and the control circuit is energized by said emergency power supply, to illuminate said lamp and activate said pulse proportional servo-motor to move the cover from said closed to said open position.

6. The light fixture of claim 5, wherein said control circuit operable, when said cover is in said open position, said lamp is illuminated and said emergency power supply is terminated, to extinguish said lamp and activate said pulse proportional servo-motor to move the cover from said open to said closed position.

* * * * *